US011965348B2

(12) United States Patent
Russell

(10) Patent No.: US 11,965,348 B2
(45) Date of Patent: Apr. 23, 2024

(54) STANCHION SURROUNDING ASSEMBLY

(71) Applicant: Scott Russell, Green Forest, AR (US)

(72) Inventor: Scott Russell, Green Forest, AR (US)

( * ) Notice: Subject to any disclaimer, the term of this patent is extended or adjusted under 35 U.S.C. 154(b) by 275 days.

(21) Appl. No.: 17/564,974

(22) Filed: Dec. 29, 2021

(65) Prior Publication Data

US 2023/0279688 A1 Sep. 7, 2023

(51) Int. Cl.

| | |
|---|---|
| ***E04H 12/22*** | (2006.01) |
| ***E01F 15/04*** | (2006.01) |
| ***E04B 1/64*** | (2006.01) |
| *E04H 17/20* | (2006.01) |

(52) U.S. Cl.

CPC ..... *E04H 12/2292* (2013.01); *E01F 15/0469* (2013.01); *E04B 1/64* (2013.01); *E04H 17/20* (2013.01)

(58) Field of Classification Search

CPC ..... E04H 12/2292; E01F 15/0469; E04B 1/64
USPC ..... 52/169.13, 170, 296, 297
See application file for complete search history.

(56) References Cited

U.S. PATENT DOCUMENTS

| | | | | | |
|---|---|---|---|---|---|
| 2,457,757 | A * | 12/1948 | Voight | E05B 55/005 | 70/144 |
| 3,571,972 | A * | 3/1971 | Carter, Jr. | E01F 15/0469 | 47/32.4 |
| 3,915,434 | A * | 10/1975 | Lister | E04F 11/1812 | 248/188.7 |
| 5,165,663 | A | 11/1992 | Wells | | |
| 5,367,822 | A | 11/1994 | Beckham | | |
| 5,746,031 | A * | 5/1998 | Burns | A62C 2/00 | 52/517 |
| 6,035,576 | A * | 3/2000 | Bozeman | A47G 7/042 | 47/47 |
| 6,328,273 | B1 * | 12/2001 | Kemikem | E04H 12/2223 | 248/156 |
| 6,955,330 | B1 * | 10/2005 | Weiser | E04H 12/2261 | 248/529 |
| 7,409,798 | B2 | 8/2008 | Freeby | | |
| 7,883,070 | B2 * | 2/2011 | Schroeder | G09F 7/18 | 248/156 |
| 9,115,507 | B2 * | 8/2015 | Wyrostek | E04H 12/2292 | |
| 9,896,163 | B2 * | 2/2018 | Lewis | B63B 17/00 | |
| 11,015,362 | B1 * | 5/2021 | Fragmin | E04H 12/2292 | |
| 2005/0072070 | A1 * | 4/2005 | Freeby | E04H 12/2292 | 52/169.9 |
| 2006/0157631 | A1 | 7/2006 | Cunningham | | |
| 2008/0000192 | A1 | 1/2008 | McGlinch | | |

(Continued)

FOREIGN PATENT DOCUMENTS

DE 202012100018 U1 * 3/2013 ..... E01F 15/0469

*Primary Examiner* — Brian E Glessner
*Assistant Examiner* — Adam G Barlow

(57) ABSTRACT

A stanchion surrounding assembly includes a first plate that has a first recess integrated into a first engaging edge of the first plate. The first recess accommodates a stanchion to inhibit vegetation from growing around the stanchion. A second plate has a second recess integrated into a second engaging edge of the second plate. The second recess accommodates the stanchion to inhibit vegetation from growing around the stanchion. The second plate engages the first plate when the first plate and the second plate are positioned against the stanchion. In this way each of the first plate and the second plate forms a disk surrounding the stanchion.

11 Claims, 8 Drawing Sheets

(56) References Cited

U.S. PATENT DOCUMENTS

| | | | | |
|---|---|---|---|---|
| 2008/0230674 | A1* | 9/2008 | Schroeder | E04H 12/2292 248/545 |
| 2010/0024335 | A1* | 2/2010 | Bianco | E02D 27/42 52/297 |
| 2012/0228572 | A1 | 9/2012 | Carswell | |
| 2021/0108436 | A1* | 4/2021 | Pitney | E04H 12/04 |

* cited by examiner

STANCHION SURROUNDING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to stanchion devices and more particularly pertains to a new stanchion surrounding device for inhibiting vegetation from growing around a stanchion. The device includes a pair of plates, each having a semi-circular shape, and each having a recess. Each of the plates is positioned on opposite sides of the stanchion such that the recess in each of the plates accommodates structural elements of the stanchion. In this way each of the plates forms a disk surrounding the stanchion for inhibiting vegetation from growing around the stanchion.

(2) Description of Related Art Including Information Disclosed Under 37 CFR 1.97 and 1.98

The prior art relates to stanchion devices including a ground anchor for insertably receiving a post. The prior art discloses a stanchion surrounding product that includes a disk and an element extending upwardly from the disk which surrounds a stanchion. The prior art discloses a barrier device for surrounding a stanchion and a granular material that is positioned in the barrier device. The prior art discloses a post support device that includes a sleeve that receives a post and a disk disposed on the sleeve for surrounding the post. The prior art discloses a pole surrounding product that includes a pair of halves, each being attachable together, to form a cylinder around a pole. The prior art discloses a fence post surrounding product that has a disk shape.

BRIEF SUMMARY OF THE INVENTION

An embodiment of the disclosure meets the needs presented above by generally comprising a first plate that has a first recess integrated into a first engaging edge of the first plate. The first recess accommodates a stanchion to inhibit vegetation from growing around the stanchion. A second plate has a second recess integrated into a second engaging edge of the second plate. The second recess accommodates the stanchion to inhibit vegetation from growing around the stanchion. The second plate engages the first plate when the first plate and the second plate are positioned against the stanchion. In this way each of the first plate and the second plate forms a disk surrounding the stanchion.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
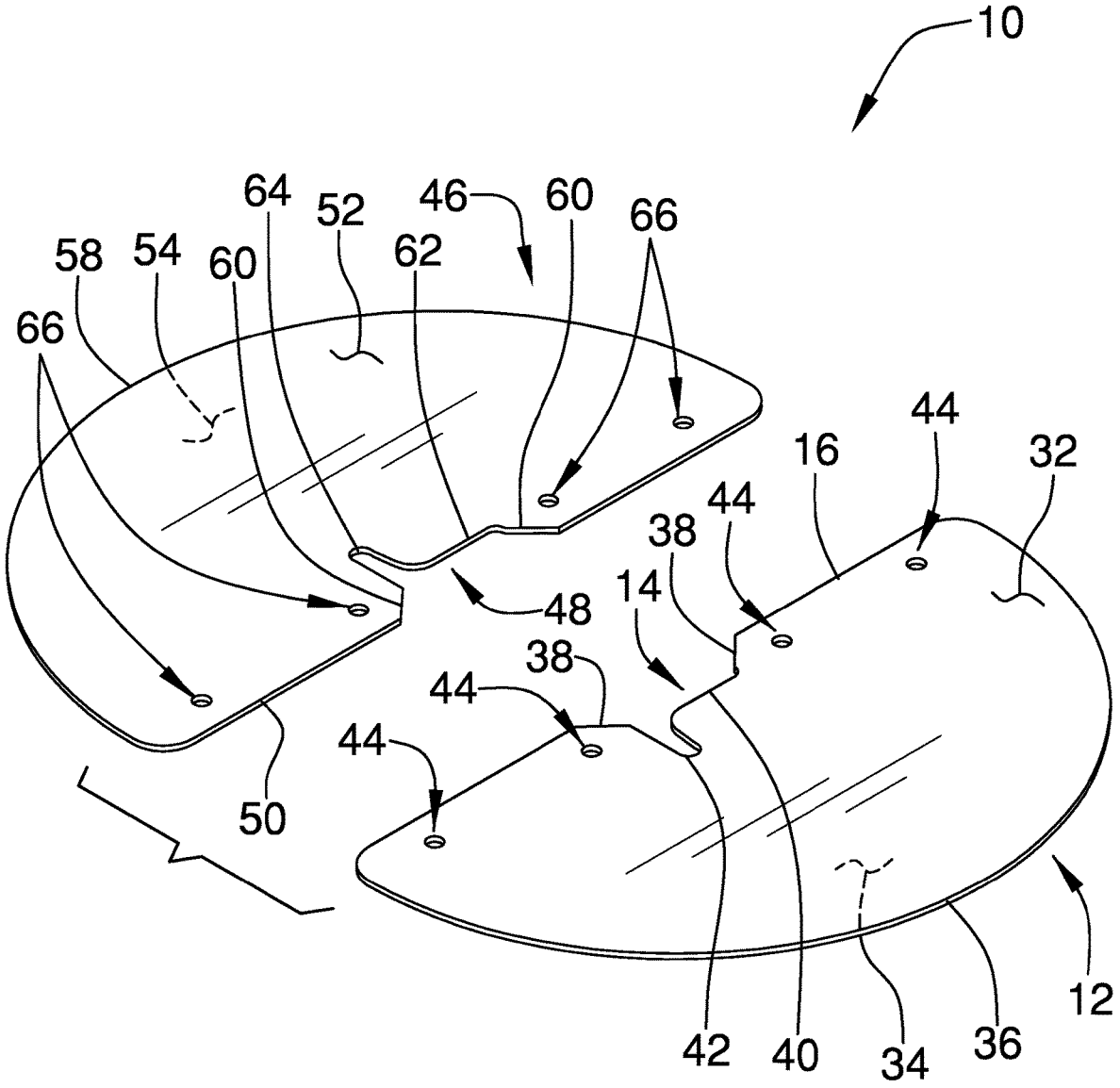
FIG. 1 is a top perspective view of a stanchion surrounding assembly according to an embodiment of the disclosure.
Figure 2:
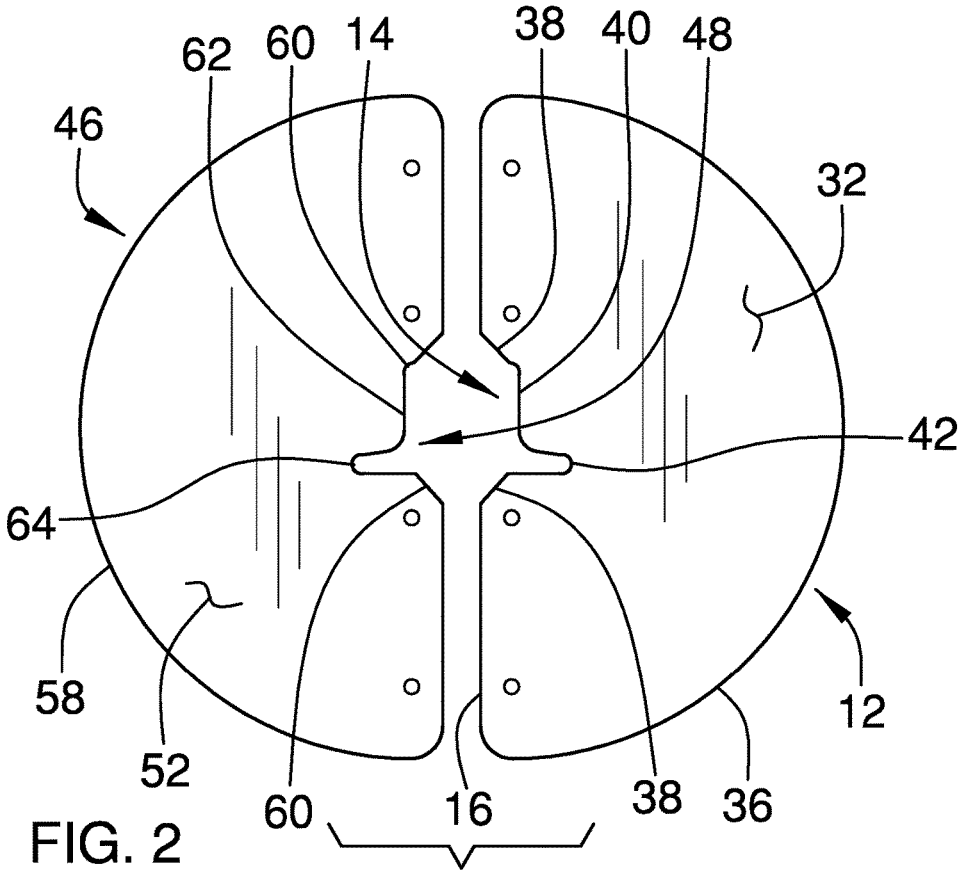
FIG. 2 is a top view of an embodiment of the disclosure.
Figure 3:
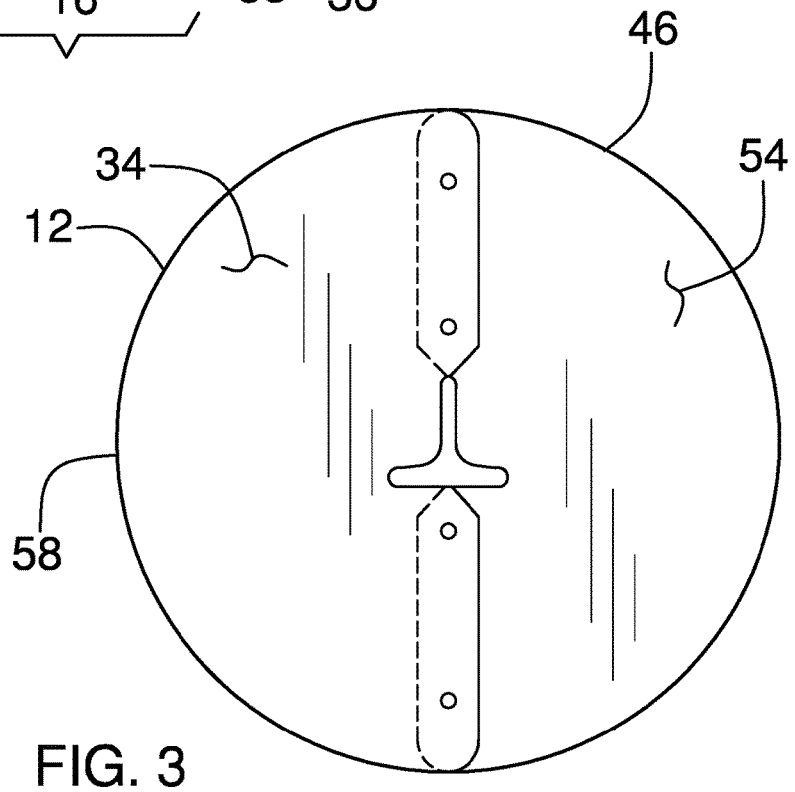
FIG. 3 is a bottom view of an embodiment of the disclosure showing a first plate and a second plate forming a disk.
Figure 4:
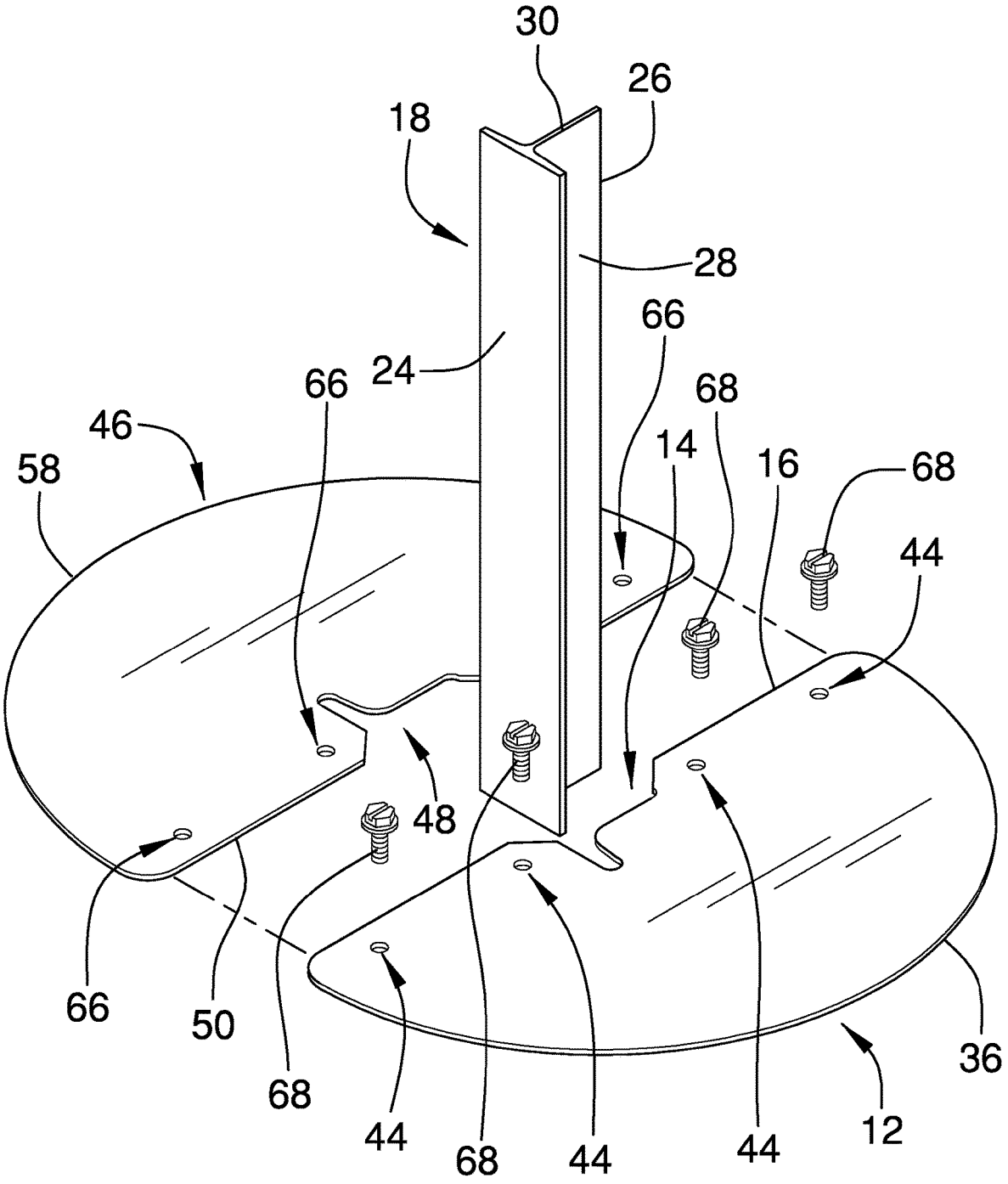
FIG. 4 is an exploded perspective view of an embodiment of the disclosure.
Figure 5:
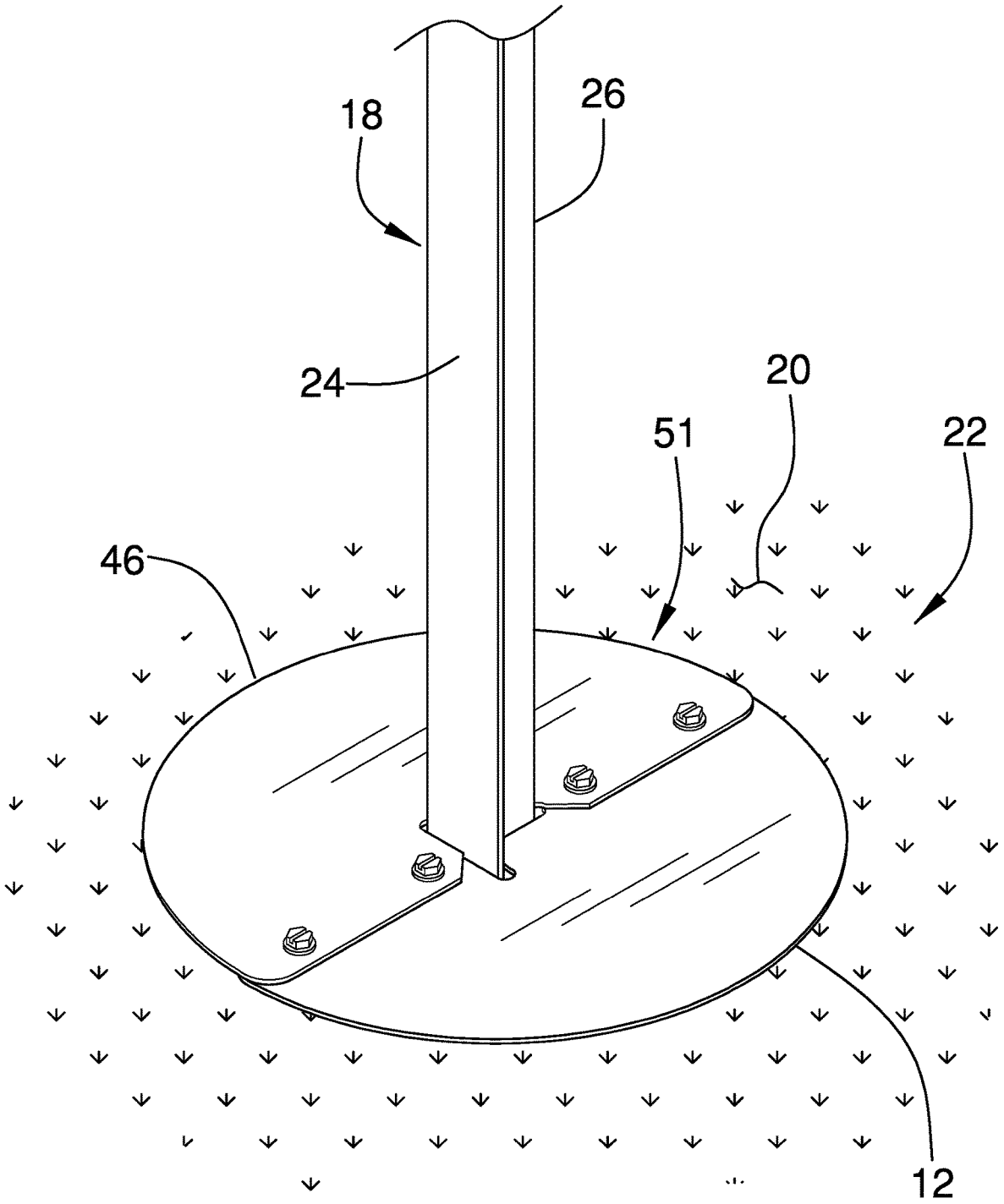
FIG. 5 is a perspective in-use view of an embodiment of the disclosure.
Figure 6:
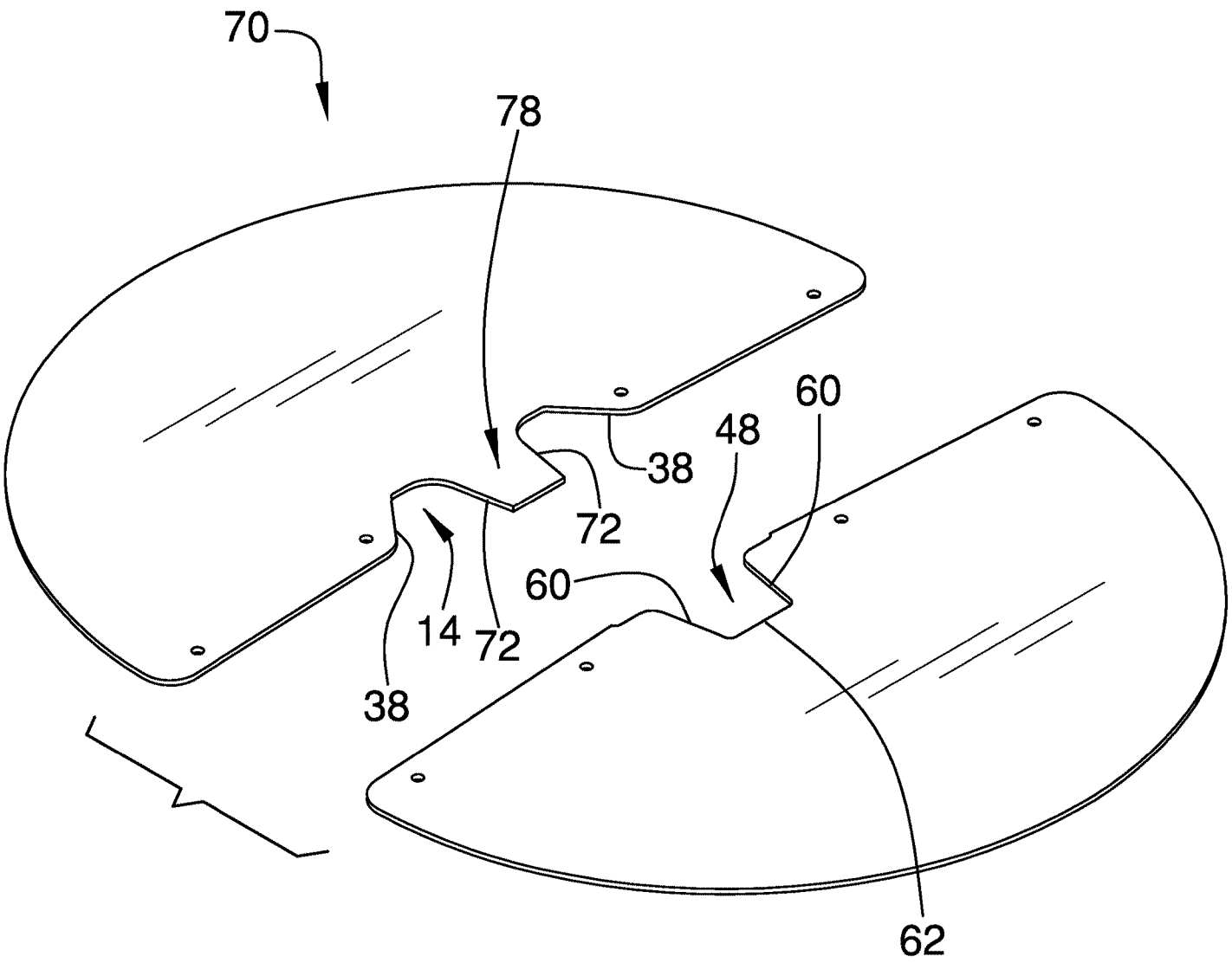
FIG. 6 is a top perspective view of an alternative embodiment of the disclosure.
Figure 7:
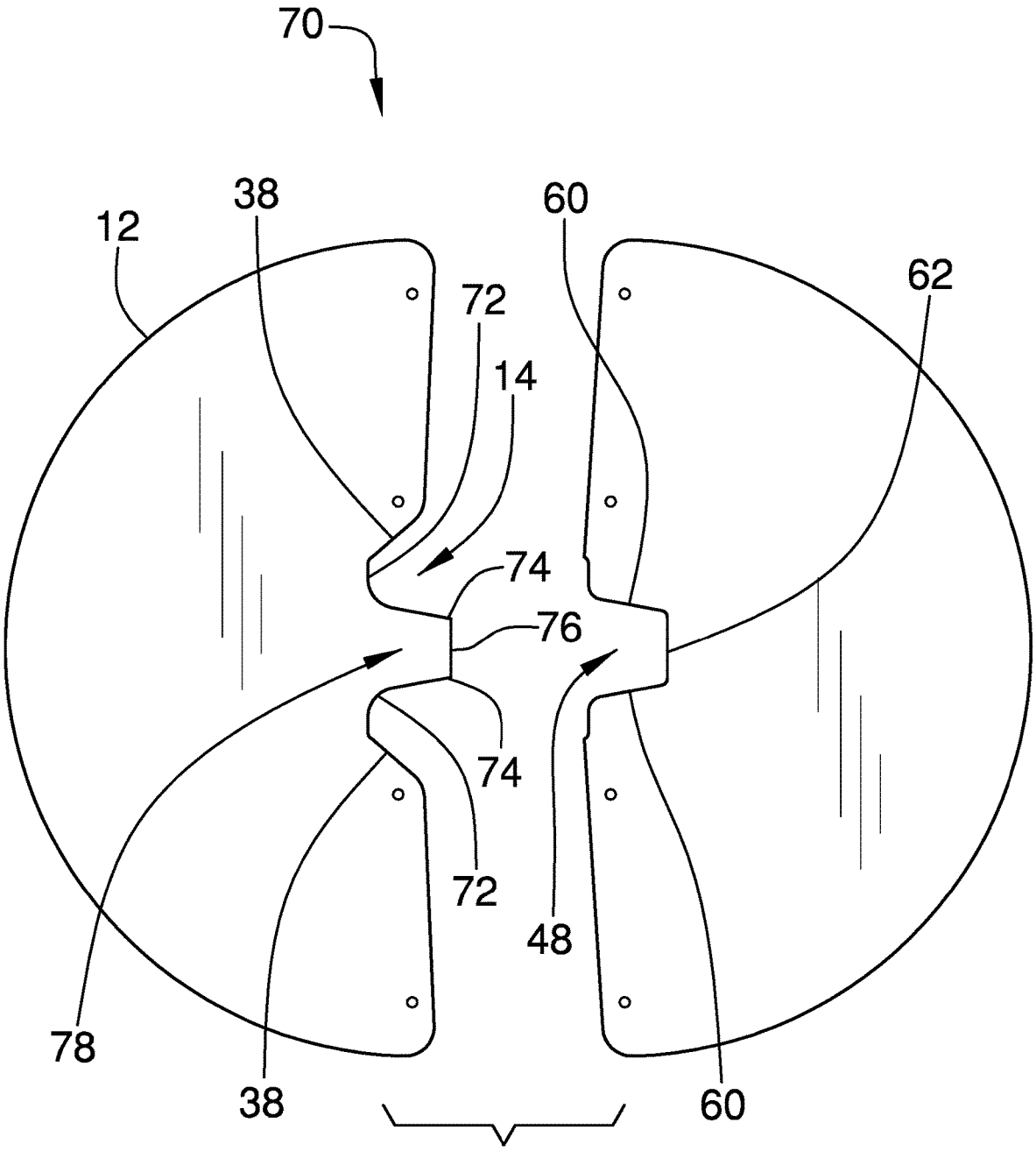
FIG. 7 is a bottom view of an alternative embodiment of the disclosure.
Figure 8:
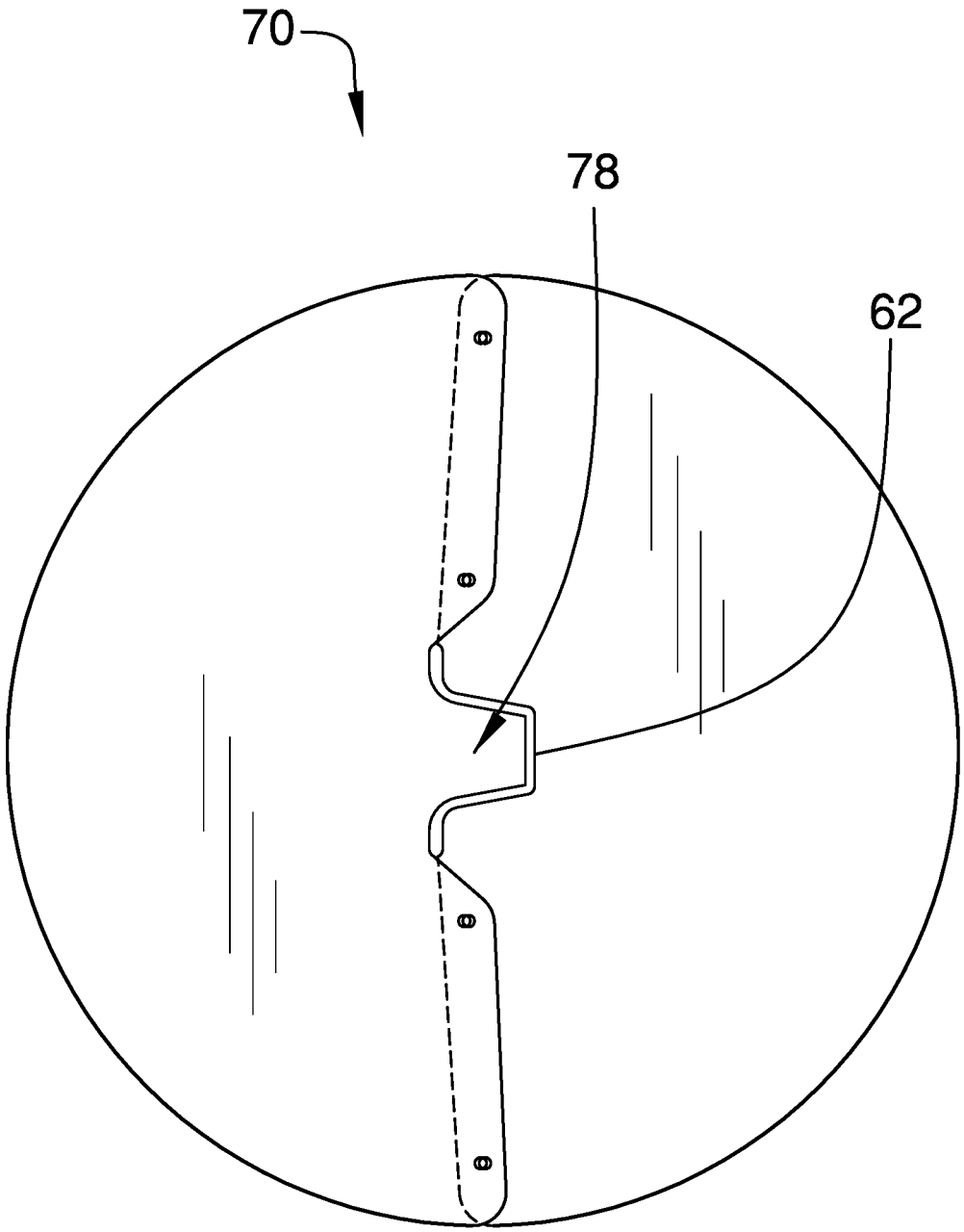
FIG. 8 is a top view of an alternative embodiment of the disclosure.
Figure 9:
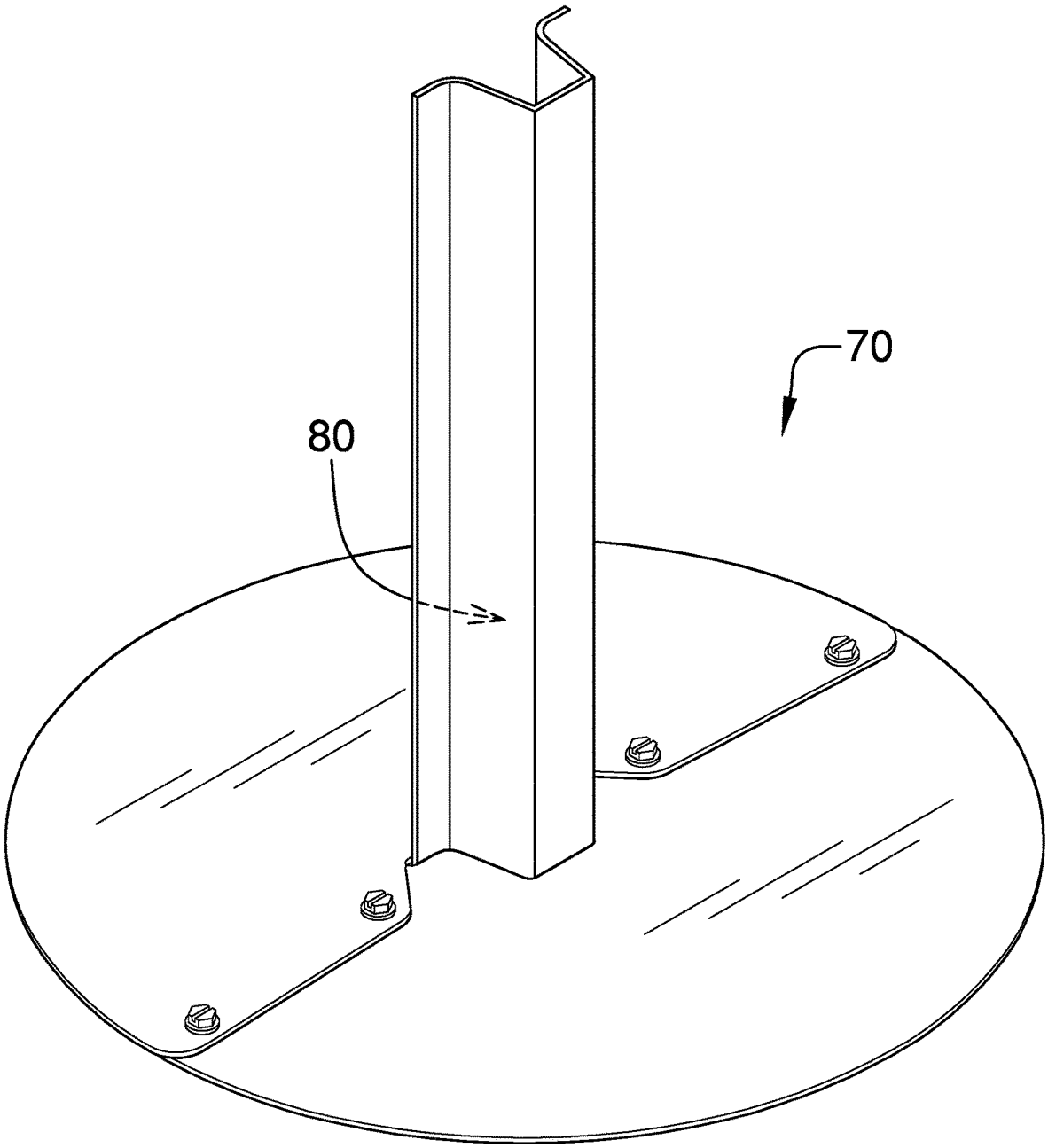
FIG. 9 is a perspective in-use view of an alternative embodiment of the disclosure.

With reference now to the drawings, and in particular to FIGS. 1 through 9 thereof, a new stanchion surrounding device embodying the principles and concepts of an embodiment of the disclosure and generally designated by the reference numeral 10 will be described.

As best illustrated in FIGS. 1 through 9, the stanchion surrounding assembly 10 generally comprises a first plate 12 that has a first recess 14 which is integrated into a first engaging edge 16 of the first plate 12. The first recess 14 accommodates a stanchion 18 having the first plate 12 lying flat on a support surface 20 in which the stanchion 18 is installed. In this way the first plate 12 inhibits vegetation 22 from growing around the stanchion 18. The stanchion 18 may be a steel fence post that includes a flange 24 and a rib 26, and the rib 26 may have a first lateral side 28 and a second lateral side 30.

The first plate 12 has a top surface 32 and a bottom surface 34, and the bottom surface 34 rests on the support surface 20 when the first plate 12 is positioned against the stanchion 18. The first engaging edge 16 extends between the top surface 32 and the bottom surface 34, and the first engaging edge 16 extends along a straight line. The first plate 12 has a rear edge 36 extending between the top surface 32 and the bottom surface 34. Moreover, the rear edge 36 follows a concavely arcuate line with respect to the first engaging edge 16 such that the first plate 12 has a semi-circular shape.

The first recess 14 has a pair of first sides 38 each extending toward the rear edge 36, and the first sides 38 are spaced apart from each other. Each of the first sides 38 angle toward each other, and the first recess 14 has a rear side 40 extending from a respective one of the first sides 38 toward an opposing first side 38. The rear side 40 extends along a line is oriented parallel to the first engaging edge 16. The first recess 14 has a first curved side 42 extending between the rear side 40 sand the opposing first side. Furthermore, the first curved side 42 curves toward the rear edge 36 such that the first curved side 42 accommodates the flange 24 on the stanchion 18 having the rear side 40 extending along a first lateral side 28 of the rib 26 of the stanchion 18.

The first plate 12 has a plurality of first holes 44 each extending through the top surface 32 and the bottom surface 34. The first holes 44 are spaced apart from each other and are distributed along the first engaging edge 16. Additionally, respective ones of the first holes 44 are positioned on opposite sides of the first recess 14 with respect to each other. Each of the first holes 44 may have a diameter of approximately 5.0 millimeters.

A second plate 46 is provided and the second plate 46 has a second recess 48 integrated into a second engaging edge 50 of the second plate 46. The second recess 48 accommodates the stanchion 18 such that the second plate 46 lies flat on a support surface 20 in which the stanchion 18 is installed. In this way the second plate 46 inhibits vegetation 22 from growing around the stanchion 18. The second plate 46 engages the first plate 12 when the first plate 12 and the second plate 46 are positioned against the stanchion 18 such that each of the first plate 12 and the second plate 46 forms a disk 51 surrounding the stanchion 18.

The second plate 46 has an upper surface 52 and a lower surface 54, and the lower surface 54 rest on the support surface 20 when the second plate 46 is positioned against the stanchion 18. The second engaging edge 50 extends between the upper surface 52 and the lower surface 54, and the second engaging edge 50 extends along a straight line. The second plate 46 has a back edge 58 extending between the upper surface 52 and the lower surface 54. The back edge 58 follows a concavely arcuate line with respect to the second engaging edge 50 such that the second plate 46 has a semi-circular shape.

The second recess 48 has a pair of second sides 60 each extending toward the back edge 58, the second sides 60 are spaced apart from each other and each of the second sides 60 angles toward each other. The second recess 48 has a back side 62 extending from a respective one of the second sides 60 toward an opposing second side 60. The back side 62 extends along a line that is oriented parallel to the second engaging edge 50. Additionally, the second recess 48 has a second curved side 64 extending between the back side 62 and the opposing second side 60. The second curved side 64 curves toward the back edge 58 such that the second curved side 64 accommodates the flange 24 on the stanchion 18 having the back side 62 extending along the second lateral side 30 of the rib 26 of the stanchion 18.

The second plate 46 has a plurality of second holes 66 each extending through the upper surface 52 and the lower surface 54. The second holes 66 are spaced apart from each other and are distributed along the second engaging edge 50 such that respective ones of the second holes 66 is positioned on opposite sides of the second recess 48 with respect to each other. Each of the second holes 66 is aligned with a respective one of the first holes 44 when each of the first disk 51 and the second disk 51 are positioned around the stanchion 18. Additionally, each of the second holes 66 may have a diameter of approximately 5.0 millimeters.

Each of the first plate 12 and the second plate 46 is comprised of a fluid impermeable material to inhibit vegetation 22 from growing through the first plate 12 and the second plate 46. Furthermore, the disk 51 formed by each of the first plate 12 and the second plate 46 has a diameter of at least 6.0 inches. In this way each of the first plate 12 and the second plate 46 inhibit the stanchion 18 from being damaged by a power tool, such as a weed trimmer for example, which is employed for trimming vegetation 22 around the disk 51 formed by the first plate 12 and the second plate 46.

A plurality of fasteners 68 is provided and each of the fasteners 68 is extendable through a respective pair of the first holes 44 and the second holes 66 when each of the first plate 12 and the second plate 46 are positioned around the stanchion 18. In this way the first plate 12 and the second plate 46 are fastened together. Each of the fasteners 68 may comprise a hex head, self tapping screw or other similar type of releasable, mechanical fastener. Furthermore, each of the fasteners 68 may comprise a #10-32×⅜ inch screw.

In an alternative embodiment 70 as is most clearly shown in FIGS. 6 through 9, the first recess 14 has a pair of sloped sides 72 each curving forwardly from a respective one of the first sides 38 toward the first engaging edge 16. Additionally, each of the sloped sides 72 has a distal end 74 with respect to the respective first side 38. The first recess 14 has a forward side 76 extending between the distal end 74 of each of the sloped sides 72 to define a tab 78 such that tab 78 extends into a pocket 80 in the stanchion 18. Continuing in the alternative embodiment 70, the back side 62 of the second recess 48 extends between each of the second sides 60 of the second recess 48 such that the second recess 48 conforms to a back side 62 of the stanchion 18. Additionally, the tab 78 defined in the first recess 14 extends into the second recess 48 when the first disk 51 and the second disk 51 are positioned around the stanchion 18.

In use, the stanchion 18 is driven into the support surface 20 and each of the first plate 12 and the second plate 46 are positioned against the stanchion 18. Each of the first plate 12 and the second plate 46 are positioned on opposite sides of the stanchion 18 such that the second engaging edge 50 of the second plate 46 overlaps the first engaging edge 16 on the first plate 12. In this way each of the second holes 66 is aligned with a respective one of the first holes 44. Additionally, each of the first recess 14 and the second recess 48 conform to the structural elements of the stanchion 18. Each of the fasteners 68 is extended through a respective pair of the first holes 44 and the second holes 66 to attach the first plate 12 to the second plate 46. In this way the first plate 12 and the second plate 46 inhibit vegetation 22 from growing next to the stanchion 18. Furthermore, the diameter of the disk 51 formed by the first plate 12 and the second plate 46 inhibit the stanchion 18 from being damaged by a power tool employed for trimming vegetation 22 around the disk 51.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A stanchion surrounding assembly for inhibiting vegetation from growing around a stanchion, said assembly comprising:

a first plate having a first recess being integrated into a first engaging edge of said first plate, said first recess accommodating a stanchion wherein said first plate is configured to lie flat on a support surface in which the stanchion is installed thereby inhibiting vegetation from growing around the stanchion; and a second plate having a second recess being integrated into a second engaging edge of said second plate, said second recess accommodating the stanchion wherein said second plate is configured to lie flat on a support surface in which the stanchion is installed thereby inhibiting vegetation from growing around the stanchion, said second plate engaging said first plate when said first plate and said second plate are positioned against, the stanchion such that each of said first plate and said second plate forms a disk surrounding the stanchion;

wherein said first plate has a rear edge;

wherein said first recess has a pair of first sides, a rear side and a first curved side;

wherein each of said first sides extends toward said rear edge, said first sides being spaced apart from each other, each of said first sides angling toward each other, said rear side extending from a respective one of said first sides toward an opposing first side;

wherein said rear side extends along a line being oriented parallel to said first engaging edge; and wherein said first curved side extends between said rear side sand said opposing first side, said first curved side curving toward said rear edge such that said first curved side accommodates a flange on the stanchion having said rear side extending along a first lateral side of the stanchion.

2. The assembly according to claim 1, wherein:

said first plate has a top surface and a bottom surface wherein said bottom surface is configured to rest on the support surface when said first plate is positioned against the stanchion, said first engaging edge extending between said top surface and said bottom surface, said first engaging edge extending along a straight line; and said rear edge extending between said top surface and said bottom surface, said rear edge following a concavely arcuate line with respect to said first engaging edge such that said first plate has a semi-circular shape.

3. The assembly according to claim 2, wherein said first plate has a plurality of first holes each extending through said top surface and said bottom surface, said plurality of first holes being spaced apart from each other and being distributed along said first engaging edge such that respective ones of said first holes is positioned on opposite sides of said first recess with respect to each other.

4. The assembly according to claim 2, wherein:

said second plate has a upper surface and a lower surface wherein said lower surface is configured to rest on the support surface when said second plate is positioned against the stanchion, said second engaging edge extending between said upper surface and said lower surface, said second engaging edge extending along a straight line;

said second plate having a back edge extending between said upper surface and said lower surface, said back edge following a concavely arcuate line with respect to said second engaging edge such that said second plate has a semi-circular shape; and said second recess has a pair of second sides, a back side and a second curved side.

5. A stanchion surrounding assembly for inhibiting vegetation from growing around a stanchion, said assembly comprising:

a first plate having a first recess being integrated into a first engaging edge of said first plate, said first recess accommodating a stanchion wherein said first plate is configured to lie flat on a support surface in which the stanchion is installed thereby inhibiting vegetation from growing around the stanchion;

a second plate having a second recess being integrated into a second engaging edge of said second plate, said second recess accommodating the stanchion wherein said second plate is configured to lie flat on a support surface in which the stanchion is installed thereby inhibiting vegetation from growing around the stanchion, said second plate engaging said first plate when said first plate and said second plate are positioned against the stanchion such that each of said first plate and said second plate forms a disk surrounding the stanchion;

wherein said first plate has a top surface and a bottom surface wherein said bottom surface is configured to rest on the support surface when said first plate is positioned against the stanchion, said first engaging edge extending between said top surface and said bottom surface, said first engaging edge extending along a straight line;

wherein said first plate has a rear edge extending between said top surface and said bottom surface, said rear edge following a concavely arcuate line with respect to said first engaging edge such that said first plate has a semi-circular shape;

wherein said first recess has a pair of first sides, a rear side and a first curved side;

wherein said first plate has a plurality of first holes each extending through said top surface and said bottom surface, said plurality of first holes being spaced apart from each other and being distributed along said first engaging edge such that respective ones of said first holes is positioned on opposite sides of said first recess with respect to each other;

wherein said second recess has a pair of second sides, a back side and a second curved side;

wherein said second plate has a back edge;

each of said second sides extends toward said back edge, said second sides being spaced apart from each other, each of said second sides angling toward each other;

said back side extends from a respective one of said second sides toward an opposing second side, said back side extending along a line being oriented parallel to said second engaging edge; and said second curved side extends between said back side and said opposing second side, said second curved side curving toward said back edge such that said second curved side accommodates a flange on the stanchion having said back side extending along a second lateral side of the stanchion.

6. The assembly according to claim 4, wherein:

wherein said first plate has a plurality of first holes each extending through said top surface and said bottom surface;

said second plate has a plurality of second holes each extending through said upper surface and said lower surface, said plurality of second holes being spaced apart from each other and being distributed along said second engaging edge such that respective ones of said second holes is positioned on opposite sides of said second recess with respect to each other; and each of said second holes is aligned with a respective one of said first holes when each of said first disk and said second disk are positioned around the stanchion.

7. The assembly according to claim 1, wherein each of said first plate and said second plate is comprised of a fluid impermeable material wherein each of said first plate and said second plate are configured to inhibit vegetation from growing through said first plate and said second plate.

8. The assembly according to claim 1, wherein said disk formed by each of said first plate and said second plate has a diameter of at least 6.0 inches wherein each of said first plate and said second plate are configured to inhibit the stanchion from being damaged by a power tool employed for trimming vegetation around said disk formed by said first plate and said second plate.

9. A stanchion surrounding assembly for inhibiting vegetation from growing around a stanchion, said assembly comprising:

a first plate having a first recess being integrated into a first engaging edge of said first plate, said first recess accommodating a stanchion wherein said first plate is configured to lie flat on a support surface in which the stanchion is installed thereby inhibiting vegetation from growing around the stanchion, said first plate having a top surface and a bottom surface wherein said bottom surface is configured to rest on the support surface when said first plate is positioned against the stanchion, said first engaging edge extending between said top surface and said bottom surface, said first engaging edge extending along a straight line, said first plate having a rear edge extending between said top surface and said bottom surface, said rear edge following a concavely arcuate line with respect to said first engaging edge such that said first plate has a semicircular shape, said first recess having a pair of first sides each extending toward said rear edge, said first sides being spaced apart from each other, each of said first sides angling toward each other, said first recess having a rear side extending from a respective one of said first sides toward an opposing first side, said rear side extending along a line being oriented parallel to said first engaging edge, said first recess having a first curved side extending between said rear side sand said opposing first side, said first curved side curving toward said rear edge such that said first curved side accommodates a flange on the stanchion having said rear side extending along a first lateral side of the stanchion, said first plate having a plurality of first holes each extending through said top surface and said bottom surface, said plurality of first holes being spaced apart from each other and being distributed along said first engaging edge such that respective ones of said first holes is positioned on opposite sides of said first recess with respect to each other;

a second plate having a second recess being integrated into a second engaging edge of said second plate, said second recess accommodating the stanchion wherein said second plate is configured to lie flat on a support surface in which the stanchion is installed thereby inhibiting vegetation from growing around the stanchion, said second plate engaging said first plate when said first plate and said second plate are positioned against the stanchion such that each of said first plate and said second plate forms a disk surrounding the stanchion, said second plate having a upper surface and a lower surface wherein said lower surface is configured to rest on the support surface when said second plate is positioned against the stanchion, said second engaging edge extending between said upper surface and said lower surface, said second engaging edge extending along a straight line, said second plate having a hack edge extending between said upper surface and said lower surface, said back edge following a concavely arcuate line with respect to said second engaging edge such that said second plate has a semicircular shape, said second recess having a pair of second sides each extending toward said back edge, said second sides being spaced apart from each other, each of said second sides angling toward each other, said second recess having a back side extending from a respective one of said second sides toward an opposing second side, said back side extending along a line being oriented parallel to said second engaging edge, said second recess having a second curved side extending between said back side and said opposing second side, said second curved side curving toward said back edge such that said second curved side accommodates a flange on the stanchion having said back side extending along a second lateral side of the stanchion, said second plate having a plurality of second holes each extending through said upper surface and said lower surface, said plurality of second holes being spaced apart from each other and being distributed along said second engaging edge such that respective ones of said second holes is positioned on opposite sides of said second recess with respect to each other, each of said second holes being aligned with a respective one of said first holes when each of said first disk and said second disk are positioned around the stanchion;

wherein each of said first plate and said second plate is comprised of a fluid impermeable material wherein each of said first plate and said second plate are configured to inhibit vegetation from growing through said first plate and said second plate;

wherein said disk formed by each of said first plate and said second plate has a diameter of at least 6.0 inches wherein each of said first plate and said second plate are configured to inhibit the stanchion from being damaged by a power tool employed for trimming vegetation around said disk formed by said first plate and said second plate; and a plurality of fasteners, each of said fasteners being extendable through a respective pair of said first holes and said second holes when each of said first plate and said second plate are positioned around the stanchion for fastening said first plate and said second plate together.

10. The assembly according to claim 9, wherein:

said first recess has a pair of sloped sides each curving forwardly from a respective one of said first sides toward said first engaging edge, each of said sloped sides having a distal end with respect to said respective first side; and said first recess has a forward side extending between said distal end of each of said sloped sides to define a tab such that tab extends into a pocket in the stanchion.

11. The assembly according to claim 10, wherein said back side of said second recess extends between each of said second sides of said second recess such that said second recess conforms to a back side of the stanchion, said tab defined in said first recess extending into said second recess when said first disk and said second disk are positioned around the stanchion.

* * * * *